United States Patent [19]

Moncaster et al.

[11] 4,234,199

[45] Nov. 18, 1980

[54] SEALING ARRANGEMENTS

[75] Inventors: Michael B. Moncaster, Cumbria; James D. Rummer, Barrow-in-Furness, both of England

[73] Assignee: Vickers Limited, London, England

[21] Appl. No.: 873,894

[22] Filed: Feb. 6, 1978

[30] Foreign Application Priority Data

Feb. 4, 1977 [GB] United Kingdom ..... 4769/77

[51] Int. Cl.[3] ..... F16S 13/00; F16S 15/10

[52] U.S. Cl. ..... 277/237 R

[58] Field of Search ..... 405/189, 188; 277/152, 277/205, 166

[56] References Cited

U.S. PATENT DOCUMENTS

| | | | |
|---|---|---|---|
| 3,462,161 | 8/1969 | Daubenberger | 277/166 |
| 3,630,533 | 12/1971 | Butler | 277/205 |
| 3,640,078 | 2/1972 | Serrano | 405/189 |
| 3,640,079 | 2/1972 | Le Therisien et al. | 405/189 |

*Primary Examiner*—Robert I. Smith

*Attorney, Agent, or Firm*—Larson, Taylor and Hinds

[57] ABSTRACT

A sealing arrangement for providing a fluid tight seal between the rim of a skirt or like member and a second member is in the form of first and second resilient concentric rings for mounting on the rim. The first ring is a sealing ring which has an annular face intended for sealing engagement with the second member. The second ring is radially displaceable so as to accommodate changes in dimension of the first ring when the first ring is deformed by the first and second members being urged together under pressure. In an embodiment, the annular face includes one or more sealing lips protruding from the face.

1 Claim, 1 Drawing Figure

Figures 1, 2:
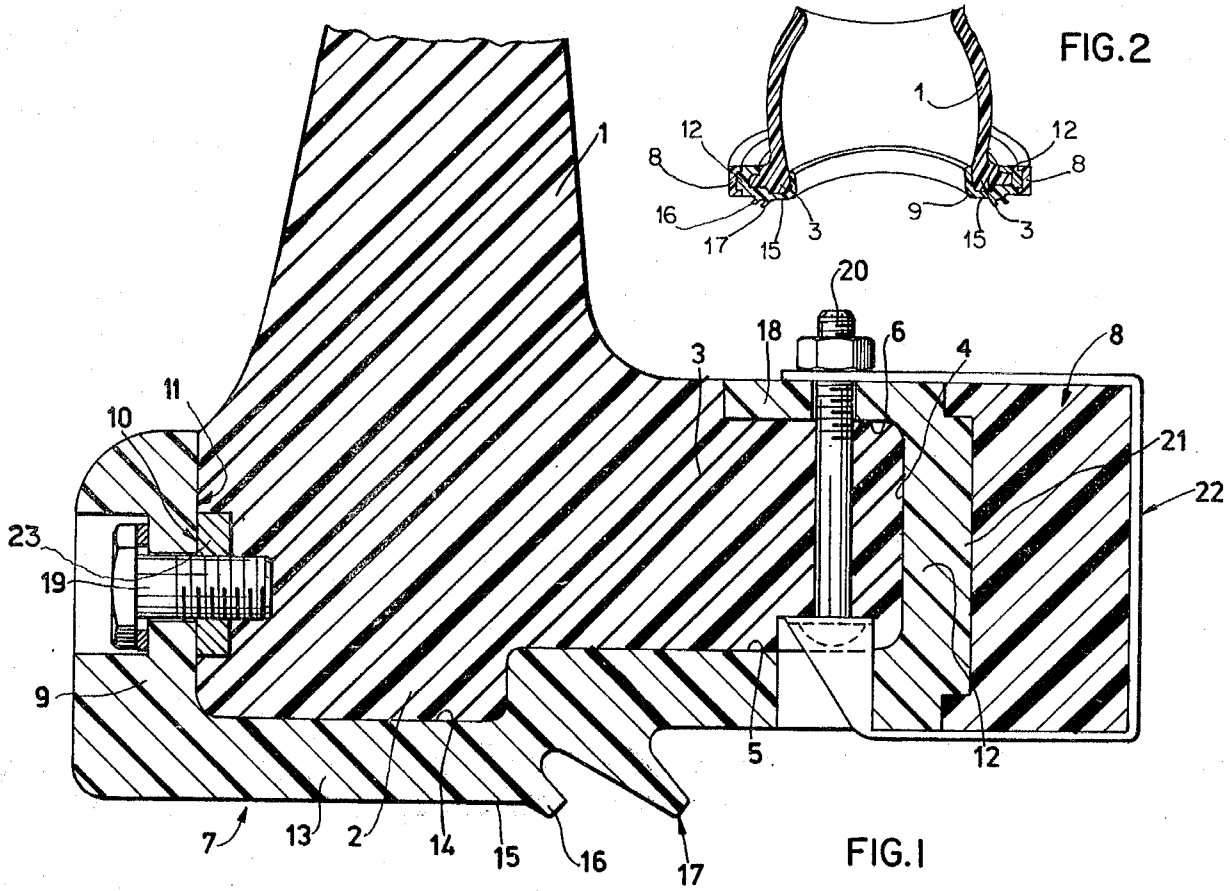

1
2
3
4
5
6
7
8
9
10
11
12
13
14
15
16
17
18
19
20
21
22
23

SEALING ARRANGEMENTS

This invention relates to a sealing arrangement and more particularly but not exclusively is concerned with an arrangement for providing a fluid tight seal between first and second members in a sub-sea environment.

According to one aspect of the present invention there is provided a sealing arrangement for providing a fluid tight seal between the rim of a skirt or like member and a second member, which arrangement comprises first and second resilient concentric rings for mounting on the rim wherein the first ring is a sealing ring having an annular face for sealing engagement with said second member and the second ring is radially displaceable so as to accommodate changes in dimension of said first ring when said first ring is deformed by the first and second members being urged together under pressure.

Preferably, the first ring includes an inner cylindrical portion intended to cooperate with the internal face of the skirt or like member adjacent to the rim, an outer cylindrical portion intended to co-operate with the external face of the skirt or like member adjacent to the rim, and annular portion linking the cylindrical portions and intended to co-operate with the rim itself. The annular portion includes the annular face intended to sealingly engage against the second member. Preferably, the annular portion additionally includes one or more sealing lips protruding beyond the annular face for engaging with the second member before engagement of the annular face with the second member so as to establish a preliminary seal between the first and second members before the main seal is established by the annular face. In the case where the skirt or like member includes at its rim an outwardly extending radial flange defined by a cylindrical surface and first and second annular faces wherein the cylindrical surface constitutes said external face and the first of said annular faces lies, in use, against the annular portion of the first ring, the first ring advantageously includes a flange on the outer cylindrical portion for co-operation with the second annular face of the flange of the skirt or like member.

Accordingly, a second aspect of the present invention provides a sealing ring for use in a sealing arrangement as hereinabove defined, which sealing ring comprises inner and outer cylindrical portions linked by an annular portion including an annular sealing face, the ring including a flange on the outer cylindrical portion and at least one sealing lip on the annular sealing face and protruding beyond said face.

In a particularly preferred embodiment the first ring has an outer cylindrical surface which is provided with a spigot and the second ring has an inner cylindrical surface which is provided with a corresponding recess so that it can receive the spigot. The second ring serves to protect the first ring generally and also serves to provide an additional restoring force to return the first ring to its rest position when the first and second members are disengaged and the pressure on the first ring is removed.

For a better understanding of the invention and to show how the same may be carried into effect, reference will now be made by way of example to the accompanying drawing in which FIG. 1 shows in section a sealing arrangement in accordance with the present invention fitted to the rim of a skirt provided on the underside of a submersible and FIG. 2 is a schematic cross section to a smaller scale showing a skirt with the sealing arrangement of the invention fitted thereto and illustrating the overall shape of the skirt and sealing arrangement.

Referring to the drawings, the skirt of the submersible (not shown) is denoted by reference numeral 1 and is formed of glass fibre reinforced plastics material (G.R.P.) and may be of the type described in my copending Patent Application No. 873,893, filed on Jan. 31, 1978. The skirt 1 has a rim 2 and, adjacent the rim an outwardly extending radial flange 3 which is an integral part of the skirt and is defined by external cylindrical surface 4 and first and second annular faces 5 and 6 respectively.

A sealing arrangement is provided on the rim of the skirt 1 to enable a water tight seal to be made between the skirt 1 and a second member (not shown) which may be for example a mating seat provided on the upper surface of a sub-sea chamber. The sealing arrangement comprises first and second resilient concentric rings generally denoted by reference numerals 7 and 8.

Ring 7 is a sealing ring and includes an inner cylindrical portion 9 having a face 10 which co-operates with the internal face 11 of the skirt at the rim and an outer cylindrical portion 12 linked by an annular portion 13 having a face 14 which co-operates with the rim 2 and first annular face 5 of the flange 3.

The inner cylindrical portion 9 of the sealing ring 7 affords protection to that portion of the inner face of the skirt which is adjacent the ring. The annular portion 13 includes an annular face 15 opposite to the face 14 and also two sealing lips 16 and 17 which protrude beyond the annular face 15.

The outer cylindrical portion 12 of the ring 7 includes a flange 18 to co-operate with the second annular face 6 of the flange 3 of the skirt. Thus, the outer part of the ring 7 essentially includes an inwardly directed annular channel which fits over the flange 3. The outer cylindrical surface of the outer cylindrical portion 12 is provided with a spigot 21. The first ring 7 is formed from a single moulding of neoprene (IRHD 50 shore hardness).

The inner part of the ring 7 is secured to the skirt by bolts 19 which extend through the inner cylindrical portion 9 and engage with threaded holes on a metal plate 23 provided on the skirt. The outer part of the ring 7 is secured to the skirt by bolts 20 passing through the flange 3.

The second ring 8 is manufactured from neoprene rubber having a shore hardness of IRHD 40 and includes on its inner cylindrical surface a recess corresponding to the spigot 21. The ring 8 is a stretch fit over the ring 7 and is positively restrained by rubber straps 22 extending around the ring and secured at their ends to the bolts 20. The ring 8 protects the ring 7 at small glancing angles and the flange 3 of the skirt from impact loads in the horizontal direction.

In use, the submersible is manoeuvred into its correct position with respect to the mating seat of the sub-sea chamber. At this time, the water within the skirt volume is at ambient pressure. This pressure is reduced by operably connecting the volume defined by the skirt with the interior of the submersible which will ordinarily be at atmospheric pressure. As a result, water in the skirt volume at ambient pressure will flow into the interior of the submersible (preferably into the trim tanks of the submersible as described in accordance with our copending patent application No. 873,893) and water will thus flow from the general body of the sea into the skirt volume. As a result of the increase in negative buoyancy of the submersible due to the admission of the water, the skirt of the submersible will be urged towards the mating seat of the sub-sea chamber so that the sealing arrangement is brought into contact with the mating surface. The flow of water into the skirt volume past the lips 16 and 17 will tend to deflect the lips into contact with the mating seat. Once such a contact has been made, flow of water from the general body of the sea into the interior of the skirt volume will be restricted and hence there will be a rapid decrease in pressure in the skirt volume as the water from the skirt volume flows into the interior of the submersible due to the pressure difference between the pressure in the skirt volume and the atmospheric pressure in the submersible. Because of this drop in pressure, the ambient pressure of the water externally of the skirt will urge the skirt, and particularly the sealing arrangement of the same, strongly against the mating seat with the result that the sealing face 15 is firmly held against the mating seat. The sealing face 15 is a relatively broad annular surface and hence a proper seal can be formed between the surface 15 and the mating seat of the sub-sea chamber even if there are small discontinuities at the mating surface as a result of, for example, debris lying on the mating seat.

As a result of the pressure difference between the interior of the skirt volume and the ambient pressure externally of the skirt, the skirt is urged against the sub-sea chamber with some considerable force. As a result, the ring 7 undergoes deformation and tends to move radially outwardly. A controlled amount of radial movement of the ring 7 is allowed in that the resiliency of the second ring 8 allows the ring 8 to be displaced radially outwards to accommodate the changes in the dimension of the ring 7.

Once the seal has been made, personnel can transfer between the submersible and the sub-sea chamber via the skirt. After the transfer of personnel has been completed and separation of the submersible and the sub-sea chamber is desired to be effected, the pressure in the skirt volume is equalised with the ambient pressure and, as a result, the compressive forces on the sealing ring 7 are released. The sealing ring 7 can then adopt its normal rest position and the second ring 8 can similarly revert to its rest position.

We claim:

1. In combination, (A) a open ended member having
  (i) a rim at its open end,
  (ii) an internal face adjacent the rim, and
  (iii) an outwardly extending radial flange adjacent the rim, and (B) a sealing arrangement for providing a fluid tight seal between the rim of the open ended member and a second member, said sealing arrangement comprising,
  (i) a resilient first ring comprising (a) an inner cylindrical portion in contact with the internal face of the open ended member, (b) an outer cylindrical portion including an inwardly directed annular channel fitted over the radial flange of the rim, and (c) an annular portion linking the cylindrical portions, said annular portion having a face in contact with the rim and an opposite annular face for sealing engagement with the second member and having at least one sealing lip protruding therefrom, and
  (ii) a resilient second ring concentrically mounted on the first ring and resiliently secured to the open ended member that the second ring is radially displaceable so as to accommodate changes in the dimension of the first ring when the first ring is deformed as a result of the first and second members being urged together under pressure.

* * * * *